US010314114B2

(12) United States Patent
Klinkmüller et al.

(10) Patent No.: US 10,314,114 B2
(45) Date of Patent: Jun. 4, 2019

(54) ELECTRIC HEATING DEVICE FOR MOBILE APPLICATIONS

(71) Applicant: Webasto SE, Stockdorf (DE)

(72) Inventors: Tino Klinkmüller, Stockdorf (DE); Stephan Buckl, Stockdorf (DE); Daniel Eckert, Stockdorf (DE); Christian Hainzlmaier, Stockdorf (DE)

(73) Assignee: WEBASTO SE, Stockdorf (DE)

( * ) Notice: Subject to any disclaimer, the term of this patent is extended or adjusted under 35 U.S.C. 154(b) by 0 days.

(21) Appl. No.: 15/577,452

(22) PCT Filed: May 29, 2016

(86) PCT No.: PCT/DE2016/100247

§ 371 (c)(1),
(2) Date: Nov. 28, 2017

(87) PCT Pub. No.: WO2016/192714

PCT Pub. Date: Dec. 8, 2016

(65) Prior Publication Data

US 2018/0152990 A1 May 31, 2018

(30) Foreign Application Priority Data

May 30, 2015 (DE) ..... 10 2015 108 580

(51) Int. Cl.
*H05B 3/10* (2006.01)
*H05B 3/16* (2006.01)
(Continued)

(52) U.S. Cl.
CPC ..... *H05B 3/46* (2013.01); *H05B 3/262* (2013.01); *H05B 3/265* (2013.01);
(Continued)

(58) Field of Classification Search
CPC ..... H05B 1/0236; H05B 3/20; H05B 3/22; H05B 3/26; H05B 3/265; H05B 3/267;
(Continued)

(56) References Cited

U.S. PATENT DOCUMENTS 3,883,719 A * 5/1975 Hurko ..... H05B 3/748 219/452.12
5,344,492 A * 9/1994 Sato ..... C23C 16/4586 118/724
(Continued)

FOREIGN PATENT DOCUMENTS

JP S61134271 A 6/1986
JP HF11 317284 A 11/1999
(Continued)

OTHER PUBLICATIONS

International Search Report and Written Opinion dated Aug. 31, 2016 in connection with PCT/DE2016/100247.
(Continued)

*Primary Examiner* — Sang Y Paik
(74) *Attorney, Agent, or Firm* — Quarles & Brady LLP

(57) ABSTRACT

An electric heating device includes a substrate and a heat conductor layer formed on the substrate. The heat conductor track includes a plurality of track sections which run adjacently to one another and are separated from one another by insulating interruptions. At least one reversal point is provided at which the heat conductor track is deflected such that inner track sections with opposite flow directions run adjacently and parallel to one another. The spacing between the adjacent inner track sections is locally expanded in the region of the reversal point where the inner track sections protrude outwards to outer track sections, and the width of the track sections is locally reduced in front of and in the outer track sections to compensate for the local expansion on
(Continued)

the inner face between the inner track sections and for the protrusion of the inner track sections.

19 Claims, 2 Drawing Sheets

(51) Int. Cl.
*H05B 3/46* (2006.01)
*H05B 3/26* (2006.01)

(52) U.S. Cl.
CPC .. *H05B 2203/003* (2013.01); *H05B 2203/013* (2013.01); *H05B 2203/021* (2013.01); *H05B 2203/023* (2013.01)

(58) Field of Classification Search
CPC ..... H05B 2203/013; H05B 2203/023; H05B 3/262
USPC ..... 219/202–205, 542–550
See application file for complete search history.

(56) References Cited

U.S. PATENT DOCUMENTS

| | | | | |
|---|---|---|---|---|
| 2007/0133964 | A1 | 6/2007 | Natsuhara et al. | |
| 2012/0111853 | A1 | 5/2012 | Lollar | |
| 2015/0163863 | A1* | 6/2015 | Wegener ..... | H05B 3/262 219/202 |

FOREIGN PATENT DOCUMENTS

| | | | |
|---|---|---|---|
| JP | 2014 212045 | A | 11/2014 |
| WO | 2007/008075 | A2 | 1/2007 |
| WO | 2008/011507 | A1 | 1/2008 |
| WO | 2011/085915 | A1 | 7/2011 |
| WO | 2013/186106 | A1 | 12/2013 |

OTHER PUBLICATIONS

The International Bureau of WIPO, English translation of International Preliminary Report on Patentability and Written Opinion of the International Searching Authority, dated Dec. 5, 2017.

* cited by examiner

ELECTRIC HEATING DEVICE FOR MOBILE APPLICATIONS

CROSS-REFERENCE TO RELATED APPLICATIONS

This application represents the national stage entry of PCT International Application No. PCT/DE2016/100247 filed on May 29, 2016, which claims the benefit of German Patent Application No. 10 2015 108 580.1 filed on May 30, 2015, the entire contents of which are incorporated herein by reference for all purposes.

FIELD

The present invention relates to an electric heating device for mobile applications, in particular to such an electric heating device that comprises a substrate and a heating conductor layer that is formed on the substrate and comprises at least one heating conductor track that extends in a main plane.

BACKGROUND

It is known to use electric heating devices for mobile applications, such as for example in a motor vehicle. There is an increasing demand for suitable electric heating devices in particular in relation to an increasing use of electrically driven vehicles. In the past, so-called PTC heating elements were predominantly used as electric heating devices for mobile applications of this type and said PTC heating elements were operated at the relatively low supply voltages that are present in the onboard electrical supply system of a conventional motor vehicle that comprises an internal combustion engine. There is a demand, particularly in the case of modern vehicles that are completely or in part electrically driven, for it to be possible to also drive the vehicle in an electric manner using the supply voltages that are present in a high voltage onboard electrical supply system that is provided in said vehicles, for example using a voltage in the range between 150 volt and 900 volt. Where appropriate, voltages up to in excess of 1000 volts are even possible.

The term a 'heating device for mobile applications' is understood to mean in the present context a heating device that is designed for use in mobile applications and is configured accordingly. This means in particular that such a heating device is transportable (where appropriate is fixedly installed in a vehicle or is merely accommodated in a vehicle for transportation purposes) and is not configured exclusively for a permanent, non-mobile application, such as by way of example in the case of a heating system in a building. The heating device can also be fixedly installed in a vehicle (land-borne vehicle, ship, etc.), in particular in a land-borne vehicle. Said heating device can be configured in particular for heating the interior compartment of a vehicle, such as by way of example of a land-borne, water-borne or air-borne vehicle and also for heating a space that is open in part, as is to be found by way of example on board ships, in particular yachts. The heating device can also be used temporarily in non-mobile applications, such as by way of example in large tents, containers (for example site trailers), etc. In particular, the electric heating device can be configured for mobile applications as a pre-heater or auxiliary heater for a land-borne vehicle, such as by way of example for a caravan, mobile home, a bus, a passenger car, etc.

WO 2013/186106 A1 describes an electric heating device for a motor vehicle having a heat resistor that is configured as a conductor track on a substrate. The conductor track is configured to be bifilar and a widened insulation region is provided in the region where a conductor track is deflected into the opposite direction. The widened insulating region is to render it possible to adjust a current flow as far as possible through the full width of the conductor track in order to be able to avoid the formation of locally inner-lying regions that have a particularly good through-flow characteristic and regions that lie in the outer-lying edge region of the conductor track and have a poor through-flow characteristic. Although characteristics that are to a certain extent satisfactory have been achieved with the described heating device, it has been established that in the region where the conductor track is deflected temperatures occur that are still greatly increased in comparison to the temperatures in the rest of the electric heating device.

SUMMARY

The object of the present invention is to provide an improved electric heating device for mobile applications wherein an essentially homogenously distributed temperature is achieved and the electric heating device is simultaneously as compact as possible and cost-effective to produce.

The object is achieved by means of an electric heating device for mobile applications in accordance with claim 1. Advantageous embodiments are disclosed in the dependent claims.

The electric heating device for mobile applications comprises a substrate and a heating conductor layer that is formed on the substrate. The heating conductor layer comprises at least one heating conductor track that extends in a main plane on the substrate, wherein the heating conductor track is structured in such a manner that a multiplicity of track sections are formed that extend adjacent to one another and are separated from one another by insulating gaps and at least one reversal site is provided at which the heating conductor track is deflected in such a manner that inner-lying track sections through which current is flowing in directions that are opposite to one another extend in an adjacent and parallel manner with respect to one another. The spacing between the adjacent inner-lying track sections through which current is flowing in opposite directions with respect to one another becomes locally wider on the inner side in the region of the reversal site. In the region of the reversal site, the inner-lying track sections protrude outwards towards track sections that lie further outwards and are separated from the inner-lying track sections by the insulating gaps and in the case of the track sections that lie further outwards the width of the track sections reduces locally in order to compensate for the local widening on the inner side between the inner-lying track sections and the protrusion of the inner-lying track sections. It is to be noted that it is not absolutely necessary for the main plane to be planar on the substrate in which the heating conductor track extends but rather said main plane can for example also be curved or bent, likewise it is also not necessary for example for the substrate to be planar but rather said substrate can also be curved or bent. The heating conductor track deflects in the main plane by at least essentially 180° in the region of the reversal site.

Since the spacing between the adjacent inner-lying track sections is configured locally wider in the region of the reversal site on the inner side and the inner-lying track sections however also protrude outwards, in comparison to an embodiment in which only the spacing on the inner side is locally widened, a great reduction in the cross section of the inner-lying track sections in the region of the reversal point is avoided. It has been established that in this manner—in comparison to the prior art mentioned in the introduction—a significantly reduced local increase in the temperature in the region of the reversal is realized with the result that a homogenous temperature distribution is achieved. Since in the case of the track sections that lie further outwards the width of the track sections is locally reduced in order to compensate the local widening on the inner side between the inner-lying track sections and the protrusion of the inner-lying track sections, it is possible simultaneously to achieve a particularly compact embodiment in which the surface of the substrate is used very efficiently for forming the heating conductor track or heating conductor tracks. The slight reduction in the cross-section associated with the track sections that lie further outwards in this embodiment does not represent a problem with regard to the temperature distribution that is to be set.

In accordance with a further embodiment, the at least one heating conductor track extends in a bifilar pattern on the substrate. The bifilar arrangement renders it possible for the heating conductor track to cover the available area on the substrate surface to a great extent whilst leaving few empty spaces. Moreover, the bifilar arrangement renders it possible to minimize possible interference radiation caused by the electric heating device. In the case of the bifilar arrangement, track sections of the heating conductor track lie adjacent to one another arranged in such a manner that track sections through which current is flowing or can flow in directions that are opposite to one another are arranged in each case extending adjacent to one another. It is preferred that at least essentially all the track sections of the heating conductor track that are provided for distributing the heat are part of the bifilar arrangement. It is possible in this manner to eliminate at least in part in a reciprocating manner the generated electromagnetic fields. It is however to be noted that in particular connection regions for connecting to an electrical power supply can also be arranged in a non-bifilar manner. The remaining regions of the heating conductor track can preferably be arranged at least essentially in a bifilar manner.

In accordance with a further development, the heating conductor track comprises two reversal sites. It is possible, in particular if the heating conductor track comprises two such reversal sites, to optimize the bifilar arrangement that produces less electromagnetic radiation and in so doing comprises only a few regions in which an increased temperature occurs during operation. It is preferred in the case of a plurality of heating conductor tracks that are formed on the substrate that each of the heating conductor tracks comprises in each case two reversal sites.

In accordance with a further development, the heating conductor layer is structured in at least two heating conductor tracks that are formed in a butterfly-like pattern on the substrate. The term 'butterfly-like pattern' is understood in this context to mean an essentially mirror-symmetrical design with regard to one plane. The at least two heating conductor tracks can preferably comprise at least one common connection to provide a connection to an electrical power supply. As a result of symmetry achieved, the configuration of heating conductor tracks in such a butterfly-like pattern renders possible a very low electromagnetic radiation when the substrate surface is used in a manner as illustrated.

In accordance with a further development, the heating conductor layer is a layer that is deposited in a planar manner on the substrate and subsequently provided with a structure by means of removing material. In this case, it is possible to produce the heating conductor track or heating conductor tracks in a particularly cost-effective manner. It is preferred that the heating conductor layer can be applied to the substrate using a thermal spray method and can be provided subsequently with a structure by means of a laser treatment method. Fundamentally, however, other methods are also conceivable for forming the heating conductor layer, such as for example printing methods, casting methods or the like. The heat-conductive layer is preferably produced from an electrically conductive metal material and separated from the material of the substrate by means of an interpositioned, electrically insulating intermediate layer that is highly thermally conductive. In particular, the heat-conductive layer can be produced for example from a nickel-chrome alloy and can be separated from the material of the substrate by means of an aluminum oxide layer. The substrate itself can preferably be highly thermally conductive, in particular produced from a metal. The respective heating conductor track can preferably have a width of a few millimeters, in particular a width of between 2.5 mm and 5 mm, and a height (extending in the direction perpendicular to the substrate) in the region of 5 μm up to 20 μm, in particular in the range of 10 μm to 15 μm.

In accordance with a further development, the electric heating device is configured as a high voltage heater for an operating voltage in the range between 150 V and 900 V, preferably between 200 V and 600 V. However, it is also possible for example to configure said electric heating device for use with voltages up to 1000 V. In this case, the electric heating device can be used in a particularly advantageous manner for example in an electric vehicle or hybrid vehicle without requiring a costly voltage converter. It is however also possible for example to configure the electric heating device as a low voltage heater for use in a range between 12 V and 48 V.

In accordance with a further development, the heating conductor layer covers at least 80% of the substrate surface, preferably at least 85% of the substrate surface. In this case, it is possible to make very good use of the available substrate surface and nonetheless it is possible to isolate the individual track sections sufficiently with respect to one another. The heating conductor layer can cover in particular less than 95% of the substrate surface.

In accordance with a further development, the width of insulating gaps is essentially constant over their entire length. In this context, the term 'essentially constant width' is understood to mean that the width varies less than 15% by an average value. It is preferred that the width of the insulating gaps varies by less than 10%. The essentially constant width of the insulating gaps renders possible a particularly cost-effective production process using an ablative process and simultaneously renders it possible to make good use of the available substrate surface.

In accordance with a further development, an electrically insulating material is arranged in the insulating gaps. It is preferred that the electrically insulating material can, in addition to covering the insulating gaps, also cover the surface of the heating conductor track or tracks that is facing away from the substrate. It is particularly preferred that the electrically insulating material is deposited in the form of a layer in particular after the heating conductor track or heating conductor tracks have been formed. The electrically insulating material renders it possible to keep the width of the insulating gaps relatively small with the result that the available surface of the substrate can be used in an efficient manner for the heating conductor track or heating conductor tracks.

In accordance with a further development, the heating conductor track is configured in such a manner that in each case two track sections through which the current flows in the same direction extend in an adjacent and parallel manner with respect to one another at least over a major portion of its length. The heating conductor track can be configured in particular in such a manner that in each case two track sections through which the current is flowing in the same direction extend in an adjacent and parallel manner with respect to one another at least over at least 80% of the length. The respective two track sections can be connected at their ends in particular in each case to a common connection section so as to provide a connection to an electrical power supply. This embodiment renders possible a particularly favorable distribution of the current that is flowing in the electric heating element and consequently renders possible a particularly homogenous distribution of the heat output. Moreover, this structuring can be formed in a cost-effective simple manner and it is possible to make good use of the available surface of the substrate.

In accordance with a further development, at least one further layer is formed on the heating conductor layer. In particular, multiple layers can also be formed on the heating conductor layer. It is preferred that it is also possible to form an insulating layer on the heating conductor layer, said insulating layer also filling the insulating gaps between the track sections on the heating conductor track. It is preferred that it is possible for example to form also a sensor layer on the insulating layer so as to monitor the function of the electric heating device. The insulating layer renders it possible to provide a high degree of safety in that current-carrying regions are additionally insulated.

In accordance with a further development, the electric heating device is a motor vehicle heating device. The electric heating device can be configured in particular so as to heat a fluid, such as for example air for an interior compartment of the vehicle or a fluid in a fluid circuit of the vehicle.

In accordance with a further development, the heating conductor track is configured in the reversal site in such a manner that in the region of the inner curve said heating conductor track is thinner in the direction perpendicular to the main plane than in the region of the outer curve. As a result of the heating conductor track being thinner in the region of the inner curve in which the current path is shortened in the direction of extension of the heating conductor path in comparison to the outer curve, the electrical resistance in the region of the inner curve is increased with respect to the region of the outer curve. It is additionally avoided in this manner that the current that is flowing through the heating conductor track principally flows in the region of the inner curve and therefore locally very high current flows are created at this site and said current flows result in a particularly intense local heating in the inner curve. Moreover, it is possible in this manner to achieve an essentially homogenous temperature profile over the entire electric heating device. The thinner thickness in the region of the inner curve produces a significantly more homogenous current distribution over the width of the heating conductor track in the curve section as a result of which the maximum temperatures that occur locally are considerably reduced. Moreover, this embodiment can be achieved in a very simple and cost-effective manner. In the case of a predetermined layout of the heating conductor track, this embodiment renders it possible to increase the achievable heat output per surface area since the possible heat output is determined primarily by the critical sites where it is possible for local "hot spots" to form.

In accordance with a further development, the heating conductor track is structured in the reversal site in such a manner that the thickness increases in steps from the inner curve towards the outer curve. Such a step-like structuring of the heating conductor track can be achieved in a particularly simple and cost-effective manner for example by means of removing in part the material from the heating conductor track, in particular for example using a laser treatment method in which the laser is moved in multiple passes over the different regions in the region of the reversal site. The heating conductor track can comprise in the reversal site in particular at least two different thickness levels (inner and outer), however it is also possible for example to form more different thickness levels with the result that the thickness of the heating conductor track increases in multiple steps from the inner curve towards the outer curve. Although such a stepped change in the thickness is preferred, it is however for example also possible that the thickness for example essentially continuously increases from the inner curve towards the outer curve.

In accordance with a further development, the thickness of the heating conductor track in the region of the inner curve is a maximum 65% of the thickness of the heating conductor track in the region of the outer curve, preferably a maximum 50%, more preferably a maximum 30%. It is possible in this manner to suppress in a particularly reliable manner the formation of undesired hot spots.

Further advantages and further developments are disclosed in the description hereinunder of an exemplary embodiment with reference to the attached drawings.

DETAILED DESCRIPTION

Embodiment

One embodiment is described in detail hereinunder with reference to the drawings.

Figure 1:
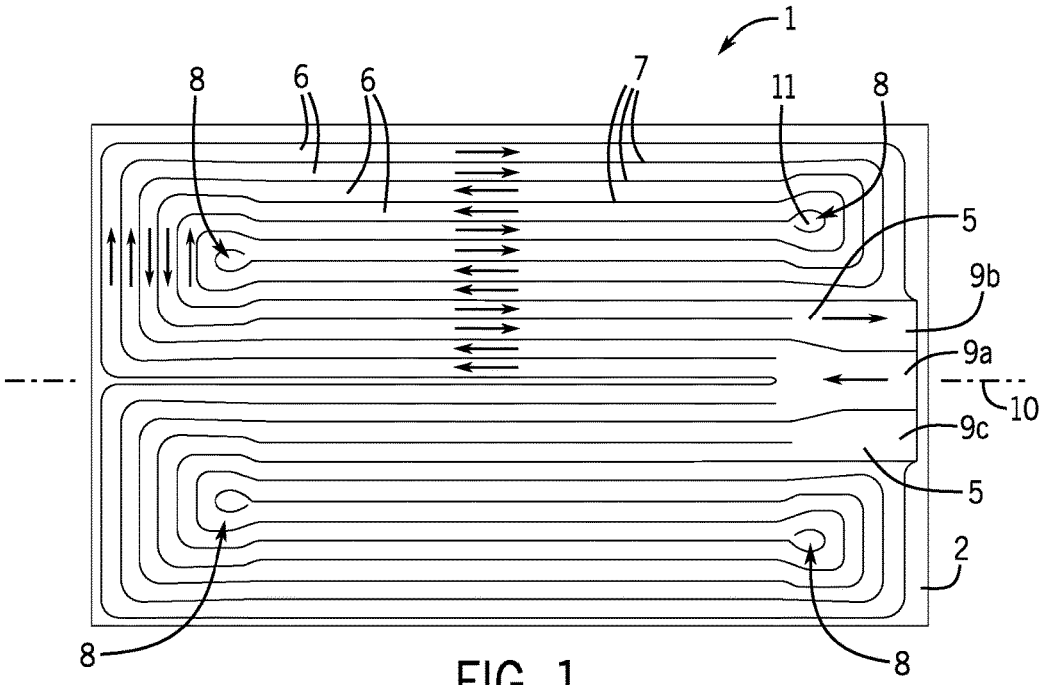
FIG. 1 is a schematic illustration of an electric heating device in accordance with the embodiment.

FIG. 1 illustrates schematically an electric heating device 1 for mobile applications in accordance with one embodiment. The electric heating device 1 in accordance with the embodiment is configured so as to heat a fluid in a vehicle. The fluid can be formed in particular for example by air that is to be heated or by a fluid in a fluid circuit of the vehicle. The electric heating device 1 is configured in particular as a high voltage heater for operation at an operating voltage in the range between 150 volt and 900 volt, in particular in the range between 200 volt and 600 volt. It is however for example also possible to configure the electric heating device 1 as a low voltage heater for operating at an operating voltage in the range for example between 12 volt and 48 volt.

The electric heating device 1 comprises a substrate 2 that can be configured in particular simultaneously as a heat exchanger for transmitting the released heat output to the fluid that is to be heated. In particular, it is possible for example to provide a lower face (not illustrated) with a plurality of heat exchanger ribs or ducts that guide the fluid that is to be heated. The substrate 2 can for example preferably be produced in a manner that is very cost-effective as far as the production technology is concerned from a metal material that has a high thermal transmission coefficient, in particular for example from aluminum or from an aluminum alloy. It is however fundamentally for example also possible to produce the substrate 2 for example from an electrically insulating material that has high thermal conductivity, such as in particular for example from a corresponding ceramic.

In the case of the specific exemplary embodiment in which the substrate 2 is formed from an electrically conductive material, an electrically insulating layer 3 that has high thermal conductivity is deposited on the substrate 2. The electrically insulating layer 3 can for example preferably be formed in particular using aluminum oxide. The electrically insulating layer 3 can for example be deposited on the substrate 2 using a thermal spray method. It is possible, particularly in the case that the substrate is formed for example from aluminum, to form the electrically insulating layer 3 for example also by purposefully oxidizing the surface of the substrate 2. The electrically insulating layer 3 is configured so as to electrically insulate the substrate 2 with respect to a heating conductor layer 4 that is described hereinunder but nonetheless so as to render it possible to transmit heat easily to the material of the substrate 2.

Moreover, the electric heating device 1 comprises a heating conductor layer 4 that is deposited on the substrate 2 (by way of example on the insulating layer 3 that is formed on the substrate 2). The heating conductor layer 4 is formed from a metal material and can comprise for example in particular a nickel-chrome alloy. The heating conductor layer 4 can preferably be deposited in particular using a thermal spray method. However, it is also possible as an alternative for example to deposit the heating conductor layer 4 for example using a printing method or casting method.

Figure 2:
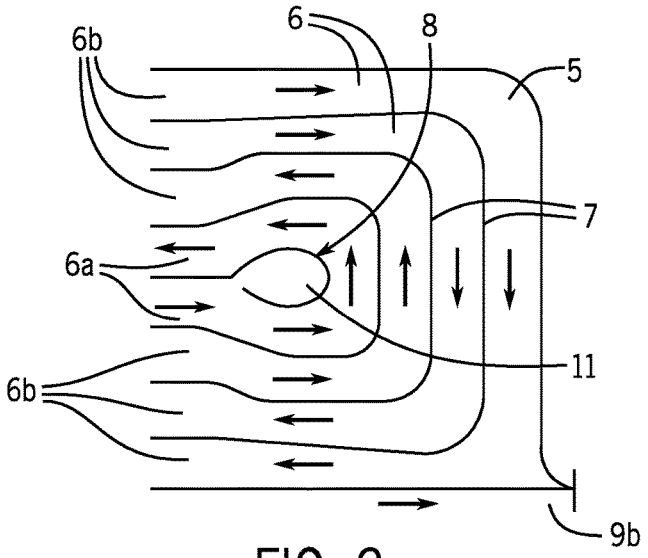
FIG. 2 is a schematic view of a detail shown in FIG. 1.

As is particularly evident in FIG. 1 and FIG. 2, the heating conductor layer 4 is structured in such a manner that at least one heating conductor track 5 is formed, said heating conductor track being configured so as to release ohmic heat if an electrical voltage is applied between the opposite-lying ends of said heating conductor track. As will be explained in detail hereinunder, the heating conductor layer 4 in the specific embodiment is structured in such a manner that two heating conductor tracks 5 are configured and said heating conductor tracks extend in a butterfly-like manner on the substrate. The butterfly-like pattern is formed in such a manner that the two heating conductor tracks 5 extend essentially in a mirror-symmetrical manner with respect to a plane E that extends in a perpendicular manner with respect to a main plane of the substrate 2.

Connections 9*a*, 9*b*, 9*c* for connecting the heating conductor tracks 5 to an electrical power supply are provided on an edge region of the electric heating device 1. In the case of the specifically illustrated embodiment, a total of three such connections are arranged adjacent to one another and electrically insulated from one another on an edge of the substrate 2. The middle connection 9*a* in the case of the specific embodiment is configured so as to electrically connect two heating conductor tracks 5. It is for example likewise possible to apply a like electrical potential to the two other connections 9*b* and 9*c* in order to set the desired potential difference at the common connection 9*a*. Since the two heating conductor tracks 5 are configured in a symmetrical manner with respect to one another, only one of the two heating conductor tracks 5 is described in detail hereinunder.

The heating conductor track 5 is structured in such a manner that it extends in a bifilar pattern on the substrate 2. The heating conductor track 5 is structured in such a manner that it comprises a multiplicity of track sections 6 that are formed adjacent to one another on the substrate 2, said track sections being separated from one another by insulating gaps 7 and consequently being electrically insulated with respect to one another. For example, the insulating gaps 7 can preferably be formed as a result of the heating conductor layer 4 having been deposited initially in a planar manner on the substrate 2 and subsequently in the region of the insulating gaps 7 the material of the heating conductor layer 4 having been purposefully removed, in particular for example using a laser treatment method. The respective current flow directions in the heating conductor track 5 are illustrated schematically by arrows in the upper region of FIG. 1 in order to make it easier to see the structure of the heating conductor track 5.

As is illustrated schematically in FIG. 1 and FIG. 2, the insulating gaps 7 that are formed between the respective track sections 6 have an at least essentially constant width over their entire length. It is achieved in this manner that the track sections 6 of the heating conductor track 5 cover a large area of the surface of the substrate with the result that maximum use is made of the available area for forming the track sections 6 that provide the heat output.

As is obvious with reference to the schematically illustrated arrows in FIG. 1, the heating conductor track 5 consequently comprises a multiplicity of track sections 6 in such a manner that track sections 6 through which the current is always flowing in the opposite direction extend adjacent to one another over the major portion of its entire length. It is achieved in this manner that the electromagnetic radiation of the electric heating device 1 is very low. As is further evident in FIG. 1, the heating conductor track 5 is configured in such a manner that the heating conductor track 5 is also divided lengthwise over a major region of its entire length in such a manner that two track sections 6 through which the current is flowing in the same direction always extend adjacent to one another and said track sections are connected to one another respectively only in the immediate proximity of the connections 9*a*, 9*b*, 9*c*. An advantageous distribution of the current flow is achieved in this manner in the plane of the substrate 2.

As a result of the described bifilar arrangement of the heating conductor track 5 in which the object is also to achieve a greatest possible area coverage of the substrate, two reversal sites 8 are formed in the case of the heating conductor track 5 (in other words in the case of each of the two heating conductor tracks 5 of the electric heating device 1 in accordance with the embodiment). The heating conductor track 5 is deflected at the reversal sites 8 in the main plane over a total of essentially 180° in such a manner that inner-lying track sections 6*a* through which current is flowing in the opposite direction are arranged separated from one another only by one insulating gap 7 and extend parallel to one another.

The configuration of the heating conductor track 5 in the region of the reversal site 8 is described in detail with reference to the detailed illustration shown in FIG. 2.

As is evident in FIG. 2, the spacing between the adjacent inner-lying track sections 6*a* is formed locally wider in the region of the reversal site 8 with the result that the deflection of the heating conductor track at the reversal site 8 encloses a region 11 that is essentially drop-shaped or the shape of a matchstick head. In the case of the specifically illustrated embodiment, the enclosed region 11 is connected in an electrically conductive manner to one of the inner-lying track sections 6*a*, in other words the heating conductor layer 4 is not interrupted with respect to this inner-lying track section 6*a*. It is however for example also possible to separate the enclosed region 11 completely from the inner-lying track sections 6*a* by means of an insulating gap 7. By virtue of the local widening of the spacing between the inner-lying track sections 6*a* in the region of the reversal site 8, an excessive difference in length is avoided between the current paths on the outer edge of the inner-lying track sections 6*a* and the current paths at the inner edge of the inner-lying track sections 6*a* with the result that an excessive concentration of the current flow at the inner side of the reversal site 8 is avoided. Such an excessive local concentration of the current flow would result in the region of the reversal site 8 being locally excessively heated.

As is likewise evident in FIG. 2, the local widening of the spacing between the inner-lying track sections 6*a* that would result in a reduction in the width of the inner-lying track sections 6*a* in this region is compensated in this embodiment at least in part by virtue of the fact that the inner-lying track sections 6*a* widen in the region of the reversal site 8 outwards in the direction of the adjacent track sections 6*b* that lie further outwards and consequently protrude further outwards. In this manner, a great local widening of the track cross-section of the inner-lying track sections 6*a* that would likewise result in an increased local temperature increase is avoided. Consequently, the formation of local "hot spots" in the region of the reversal site is suppressed in a particularly reliable manner. In particular—in comparison to an embodiment in which the spacing only widens on the inner side at the expense of the track width of the inner-lying track sections 6*a*—the temperature that is produced at the reversal sites 8 is significantly reduced. Moreover, in the region of the reversal site 8, the width of the track sections 6*b* that lie further outwards and are separated from the inner-lying track sections 6*a* by insulating gaps 7 reduces locally in order to compensate the increased space required by the previously described embodiment of the inner-lying track sections 6*a* in the region of the reversal site 8. In other words, in the case of the track sections 6*b* that lie further outwards, the width of the track sections is reduced locally in order to compensate the local widening on the inner side between the inner-lying track sections 6*a* and the protrusion of the inner-lying track sections 6*a*. In this manner, it is achieved that the heating conductor track 5 makes the greatest possible optimum use of the available surface of the substrate 2 and that the insulating gaps 7 overall only occupy the portion of the surface area of the substrate 2 that is necessary to provide a reliable insulation.

Figure 3:
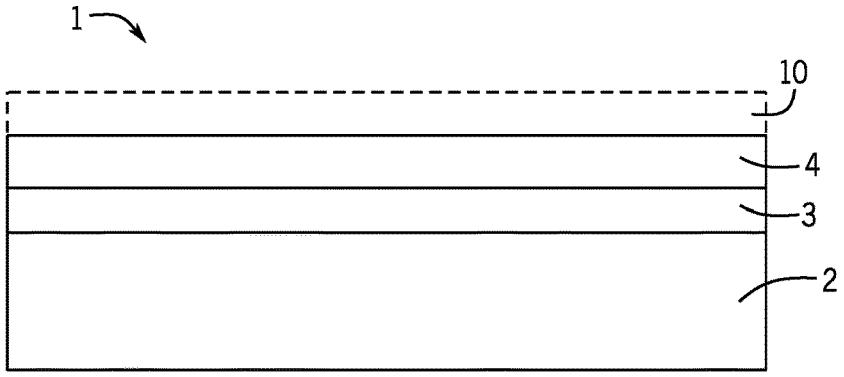
FIG. 3 illustrates schematically the arrangement of a heating conductor layer on a substrate in the case of the embodiment.

As is illustrated schematically in FIG. 3, at least one further insulating layer 10 is formed on the heating conductor layer 4, in other words on the correspondingly structured heating conductor tracks 5, which have previously been described and said insulating layer covers the upper face, which faces away from the substrate 2, of the heating conductor layer 4. In the case of the embodiment, the further insulating layer 10 is in particular configured in such a manner that it also fills the insulating gaps 7 between the track sections 6 of the heating conductor track 5. In this manner, it is ensured that the track sections 6 are particularly well insulated from one another. The further insulating layer 10 can be deposited on the structured heating conductor tracks 5 for example after the heating conductor layer 4 has been structured. It is for example in turn preferred that said further insulating layer can be deposited on said structured heating conductor tracks by means of a thermal spray method, a casting method or the like. In particular, the further insulating layer 10 can be formed for example in turn using aluminum oxide in order to achieve a good electrical insulation and simultaneously high thermal conductivity.

It is preferred for example that it is also possible to provide one or multiple further layers on the further insulating layer 10. In particular, it is possible for example in an advantageous manner to form at least one sensor layer for monitoring the function of the electric heating device 1.

Variation

Figure 4:
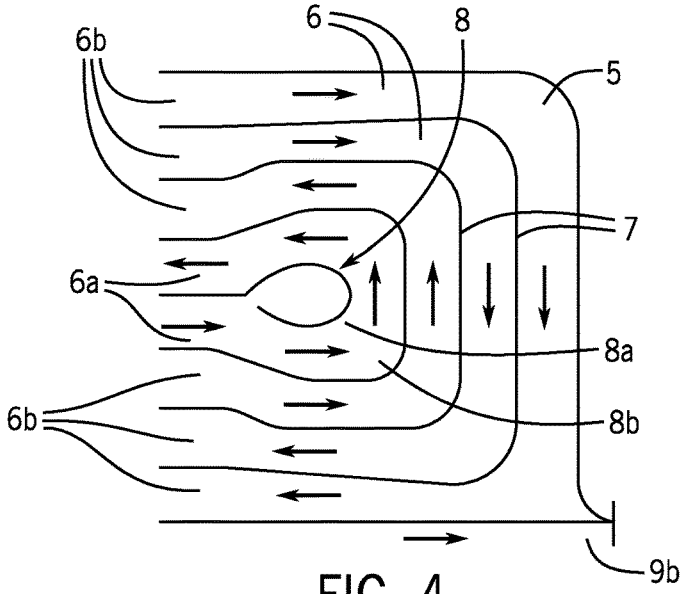
FIG. 4 is a schematic illustration corresponding to FIG. 2 of a variation of the embodiment.
Figure 5:
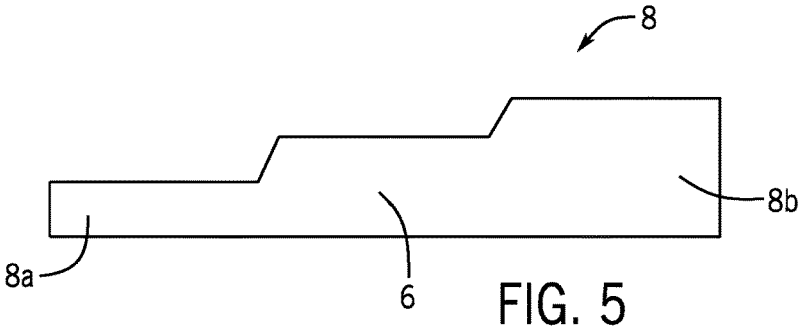
FIG. 5 is a schematic illustration of a cross-section of the heating conductor track in the region of a reversal site in the case of the variation.

A variation of the previously described embodiment is described in detail hereinunder with reference to FIG. 4 and FIG. 5. Since the variation from the previously described embodiment only differs with regard to the structuring of the thickness of the heating conductor track 5 in the reversal site 8, the identical reference numerals are used for the variation and in order to avoid repetitions a repeat description of all the components is not provided.

In order to solve or at least lessen the problem of undesired "hot spots" forming in particular in the region of the reversal site 8 of the heating conductor track 5, the heating conductor track 5 is formed in the exemplary embodiment at least at the reversal site 8 in such a manner that in the region of the inner curve 8*a* the thickness of said heating conductor track is thinner in the direction perpendicular to the main plane than in the region of the outer curve 8*b*. In the case of the specific exemplary embodiment, the heating conductor track 5 is structured in such a manner that its thickness increases in steps from the inner curve 8*a* towards the outer curve 8*b*, as illustrated schematically in FIG. 5. Such a step-like structuring in the transverse direction with respect to the heating conductor track 5 can be formed in a very simple and cost-effective manner for example by virtue of the fact that, from a starting thickness of the heating conductor layer 4 that is left in the region of the outer curve 8*b*, material is removed in part from the heating conductor track 5 in the regions that are arranged further in the direction of the inner curve 8*a* by means of a laser treatment method until a thinner thickness is achieved. It is preferred that this can be performed in particular in the same procedural step in which the material of the heating conductor layer 4 is also removed so as to form the insulating gaps 7.

As illustrated schematically in FIG. 5, the heating conductor track 5 can be structured in the curve section 8 for example with two steps in such a manner that overall in the transverse direction with respect to the heating conductor track 5 three height levels are realized. However, it is for example also possible for example to form only two different height levels or to form more than three height levels. The thickness of the heating conductor track 5 can be reduced preferably in the region of the inner curve 8*a* considerably in comparison to the region of the outer curve 8*b*. In particular, the thickness of heating conductor track 5 in the region of the inner curve 8*a* can be for example a maximum 65% of the thickness of the heating conductor track 5 in the region of the outer curve 8*b*, preferably a maximum 50%, more preferably a maximum 30%. In a non-limiting example, the heating conductor track 5 can be for example approx. 25 μm thick in the region of the outer curve 8*b*, only approx. 5 μm thick in the region of the inner curve 8*a* and approx. 15 μm thick in the region lying between said regions. In an example of this type, it has been established for example that the temperature in the inner curve 8*a* can be significantly reduced by approx. 60° C. (in the specific example for example from approx. 240° C. to approx. 180° C.). The reduction in thickness of the heating conductor layer 4 in the region of the inner curve 8*a* results in a homogenous distribution of the electric current over the width of the heating conductor track 5 as a result of the increase in the electrical resistance in the inner curve 8*a* that is associated with said reduction in width. In this manner, the risk caused by the "hot spots" of a reduced serviceable life of the electric heating device 1 is significantly reduced. Overall, it is also possible in this manner to increase the heat output from the electric heating device 1 since the achievable heat output is essentially limited by the "hot spots".

Although, in particular in the region of the reversal site 8, the achievable effect is particularly significant, it is for example also possible in other curve sections that are not reversal sites 8 of this type, to reduce the thickness of the heating conductor layer 4 in the region of the inner curve in order to achieve a homogenous current distribution over the width of the heating conductor track 5.

The local reduction of the thickness in the region of the inner curve 8*a* of a reversal site 8 can be formed in particular for example relatively locally over a region in the direct proximity or surroundings of the reversal point 8, as is indicated schematically by broken lines in particular in FIG. 4. In the case of the embodiment illustrated schematically in FIG. 4, the additional structuring of the thickness of the heating conductor track 5 is realized for example only in the region to the right of the broken lines whereas in the region to the left of the broken lines the heating conductor track 5 has an essentially constant thickness over its width.

The described reduction in thickness of the heating conductor track 5 renders it possible in the inner curve 8*a* of the reversal site 8 to suppress the inclination to form hot spots to such a great extent that it is possible to reduce the extent to which the spacing reduces between adjacent inner-lying track sections 6*a* in the region of a reversal site 8. It is possible in this manner to make better use of the surface area of the substrate 2.

The invention claimed is:

1. An electric heating device for mobile applications, having:

a substrate and a heating conductor layer that is formed on the substrate, wherein the heating conductor layer comprises at least one heating conductor track that extends in a main plane on the substrate, wherein the heating conductor track is structured in such a manner that a multiplicity of track sections are formed that extend adjacent to one another and are separated from one another by insulating gaps and at least one reversal site is provided at which the heating conductor track is deflected in such a manner that inner-lying track sections through which current is flowing in opposite directions with respect to one another extend in an adjacent and parallel manner with respect to one another, wherein the spacing between the adjacent inner-lying track sections through which current is flowing in opposite directions with respect to one another is locally widened on the inner side in the region of the reversal site, characterized in that in the region of the reversal site, the inner-lying track sections protrude outwards towards track sections that lie further outwards and are separated by insulating gaps from the inner-lying track sections and in the case of the track sections that lie further outwards the width of the track sections is locally reduced only in the region of the reversal site in order to compensate the local widening on the inner side between the inner-lying track sections and the protrusion of the inner-lying track sections.

2. The electric heating device as claimed in claim 1, wherein the at least one heating conductor track extends in a bifilar pattern on the substrate.

3. The electric heating device as claimed in claim 1, wherein the heating conductor track comprises two reversal sites.

4. The electric heating device as claimed in claim 1, wherein the heating conductor layer is structured in at least two heating conductor tracks that are formed in a butterfly-like pattern on the substrate.

5. The electric heating device as claimed in claim 1, wherein the heating conductor layer is a layer that is deposited in a planar manner on the substrate and subsequently structured by removing material.

6. The electric heating device as claimed in claim 1, wherein the electric heating device is configured as a high voltage heater for an operating voltage in the region between 150 V and 900 V.

7. The electric heating device as claimed in claim 1, wherein the heating conductor layer covers at least 80% of the substrate surface area.

8. The electric heating device as claimed in claim 1, wherein the insulating gaps have an essentially constant width over their entire length.

9. The electric heating device as claimed in claim 1, wherein an electrically insulating material is arranged in the insulating gaps.

10. The electric heating device as claimed in claim 1, wherein the heating conductor track is configured in such a manner that in each case two track sections through which current is flowing in the same direction extend in an adjacent and parallel manner with respect to one another at least over a major portion of its length.

11. The electric heating device as claimed in claim 1, wherein at least one further layer is provided on the heating conductor layer.

12. The electric heating device as claimed in claim 1, wherein the electric heating device is a motor vehicle heater.

13. The electric heating device as claimed in claim 1, wherein the heating conductor track is configured in the reversal site in such a manner that in a region of an inner curve it is thinner in a perpendicular to the main plane than in a region of an outer curve.

14. The electric heating device as claimed in claim 13, wherein the heating conductor track is structured in the reversal site in such a manner that the thickness increases in steps from the inner curve towards the outer curve.

15. The electric heating device as claimed in claim 13, wherein a thickness of the heating conductor track in the region of the inner curve is a maximum 65% of the thickness of the heating conductor track in the region of the outer curve.

16. The electric heating device as claimed in claim 1, wherein the electric heating device is configured as a high voltage heater for an operating voltage in the region between 200 V and 600 V.

17. The electric heating device as claimed in claim 1, wherein the heating conductor layer covers at least 85% of the substrate surface area.

18. The electric heating device as claimed in claim 13, wherein a thickness of the heating conductor track in the region of the inner curve is a maximum 50% of the thickness of the heating conductor track in the region of the outer curve.

19. The electric heating device as claimed in claim 13, wherein a thickness of the heating conductor track in the region of the inner curve is a maximum 30% of the thickness of the heating conductor track in the region of the outer curve.

* * * * *